United States Patent [19]

Saito et al.

[11] Patent Number: 4,973,934

[45] Date of Patent: Nov. 27, 1990

[54] PTC THERMISTOR DEVICE

[75] Inventors: Kazuo Saito; Michikazu Takeuchi, both of Akita, Japan

[73] Assignee: TDK Corporation, Tokyo, Japan

[21] Appl. No.: 366,515

[22] Filed: Jun. 15, 1989

[30] Foreign Application Priority Data

Jun. 15, 1988 [JP] Japan ..... 63-79242[U]

[51] Int. Cl.[5] ..... H01C 7/00

[52] U.S. Cl. ..... 338/22 R; 29/612; 29/619; 338/324

[58] Field of Search ..... 338/22 R, 22 SD, 322, 338/324, 325, 333, 334; 25/610.1, 612, 619, 621

[56] References Cited

U.S. PATENT DOCUMENTS

| | | | |
|---|---|---|---|
| H498 | 7/1988 | Keller | 338/332 X |
| 3,568,013 | 3/1971 | Blaha | 29/589 X |
| 3,750,082 | 7/1973 | Petersen | 338/226 |
| 4,241,370 | 12/1980 | De Filippis et al. | 338/316 X |
| 4,325,051 | 4/1982 | Rodriguez | 338/22 SD X |
| 4,431,983 | 2/1984 | Rodriguez | 338/22 R X |
| 4,635,026 | 1/1987 | Takeuchi | 338/22 R X |

FOREIGN PATENT DOCUMENTS 59-17510 4/1984 Japan .

*Primary Examiner*—C. L. Albritton

*Attorney, Agent, or Firm*—Fleit, Jacobson, Cohn, Price, Holman & Stern

[57] ABSTRACT

A PTC thermistor device including a PTC thermistor element of a circular configuration, and a casing made of a plastic material. The casing has a substantially parallelepipedic body portion and a projecting portion having a pair of parallel side surfaces and a planar top surface. A terminal fitting is provided in contact with the PTC element and has plug portions projecting from the casing at the opposite sides of the projecting portion. The plugs has projecting lengths which are not higher than the height of the projecting portion of the casing.

9 Claims, 9 Drawing Sheets

PTC THERMISTOR DEVICE

BACKGROUND OF THE INVENTION

1. Field of the Invention

The present invention relates to a thermistor device having a positive thermal coefficient. More particularly, the present invention pertains to a PTC (positive thermal coefficient) thermistor device including a disc-shaped PTC element held in a casing provided with plug elements for external connection.

2. Description of the Prior Art

A PTC thermistor device has been widely used in a starting circuit for induction motors as a motor starting relay. Examples of such thermistor are disclosed by the Japanese utility model publication 58-34722 and the Japanese patent publication 63-18817. FIGS. 19 through 21 show a PTC thermistor device of this type. Referring to FIG. 20, it will be noted that the thermistor device has a PTC element 1 comprising a circular disc body 101 of a PTC material and a pair of electrodes 102 and 103 provided at the opposite sides of the body 101. The PTC element 1 is located in a casing 2 of an electrically insulative material such as a plastic material. The casing is formed with an internal space 21 for housing the PTC element 1. In order to support the PTC element 1 in the casing 2, there is provided an insulative plate 5 which has a circular opening 51 to which the PTC element 1 is fitted. The casing is formed at the inner surface with a groove 22 for receiving the periphery of the insulative plate 5. Thus, the PTC element 1 is loosely supported by the casing 2 by having the periphery of the insulative plate engaged with the groove 51 in the casing 2.

At the opposite sides of the PTC element 1, there are provided terminal assemblies 3A and 3B each of which includes a contact 31 and a socket receptacle 32. Each of the contact 31 is attached to the inner wall of the casing 2 at an intermediate portion and formed with two resilient leg portions which are in resilient contact with one of the electrodes 102 and 103. The contacts 31 are electrically connected with respective ones of the socket receptacles 32. As shown in FIGS. 20 and 21, the socket receptacles 32 are arranged in parallel with each other with one ends exposed outside at one surface 25 of the casing 2 to thereby form a socket.

There are also provided a pair of plug legs 33 which are connected with respective ones of the socket receptacles 32 and project outwardly from the side of the casing 2 opposite to the side where the socket receptacles 32 are exposed outside. As shown in FIG. 19, the casing is formed with a semi-cylindrical portion having a pair of opposite side surfaces 26 and 27 and a semi-cylindrical outer surface 28 for accommodating the PTC element 1 of a circular disc shape. The plug legs 33 extend outwardly substantially along the side surfaces 26 and 27 and have outer end portions 331 extending beyond the outer surface 28 of the semi-cylindrical portion of the casing 2.

As shown in FIG. 21, the thermistor device of the aforementioned structure is attached to a motor M by inserting terminal plugs T on the motor M into the socket receptacles 32 of the terminal assemblies 3A and 3B with the plug legs 33 projecting toward the other side. The plug legs 33 are connected with a socket for connecting the thermistor device with another part such as a capacitor.

In this type of thermistor device, it has been experienced that in mounting the device on the motor by having the socket receptacles 33 engaged with the plugs T on the motor M fingers of a workman are apt to slip on the outer surface of a round configuration to make the assembling work difficult. It should further be noted that the plug legs 33 projecting beyond the outer surface 28 of the casing 2 are very often deformed or contaminated by being touched by fingers of a workman. The contamination of the plug legs may cause corrosion and reliability of electrical contact may be destroyed.

It should further be noted that in the thermistor device of this type dusts are apt to accumulate on the round outer surface 28 of the casing 2. Such accumulation of dusts may cause a decrease in insulative property between the plug legs 33 because the dusts on the surface 28 have water absorbing property. As the result, there may be produced a surface discharge along the outer surface 28 of the casing 2.

SUMMARY OF THE INVENTION

It is therefore an object of the present invention to provide a PTC thermistor device which can be readily mounted on a motor.

Another object of the present invention is to provide a PTC thermistor device in which possibility of plugs being deformed during mounting operation can significantly be decreased.

A further object of the present invention is to provide a PTC thermistor device in which surface discharge across plug legs can be effectively prevented.

According to the present invention, the above and other objects can be accomplished by a PTC thermistor device including a casing and a PTC element supported in said casing, said PTC element having opposite side surfaces provided with electrode means, said casing having opposite side surfaces complementary to said opposite side surfaces of the PTC element, plug means connected with said electrodes and extending outside said casing for external connection, said plug means extending substantially parallel with said opposite side surfaces of the casing, said side surfaces of said casing merging to an outer end surface which is of a planar configuration, said plug means terminating at an outer end portion which is located in a confine of said side surface of said casing.

According to the thermistor structure of the present invention, the plug means terminates within the confine of the side surfaces of the casing so that it will not be likely that the plug means is touched by fingers of the workman when the thermistor device is being mounted on a motor. It should further be noted that the side surfaces of the casing terminate at an end surface which is of a planar configuration so that the plugs extending along the respective side surfaces are sufficiently separated and there will be no danger of a surface discharge being produced even when dusts are accumulated on the end surface.

According to a preferable mode of the present invention, the electrode at each side of the PTC element is of a two layer structure comprising a first layer attached to the side surface of the PTC element and a second layer on the first layer. Preferably, the second electrode layer has a diametrical dimension which is smaller than that of the first layer. The first electrode layer is made of an electrically conductive material other than silver and is in ohmic contact with the PTC element. The second electrode layer is made of a material based on silver.

With this structure, it is possible to provide silver electrodes without problem of silver migration.

The above and other objects and features of the present invention will become apparent from the following description of preferred embodiments taking reference to the accompanying drawings.

DESCRIPTION OF THE PREFERRED EMBODIMENT

Figure 1:
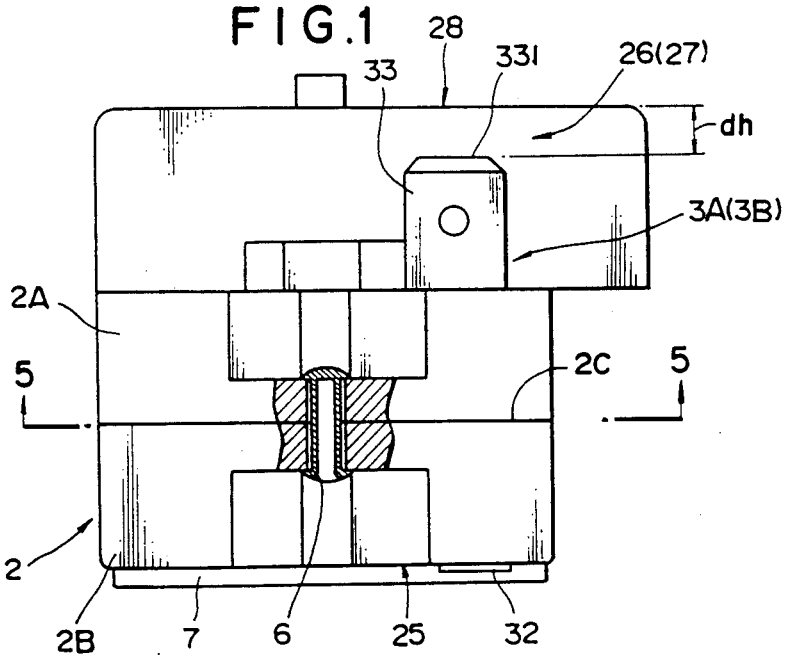
FIG. 1 is partially broken away front view of a thermistor device in accordance with one embodiment of the present invention.

Referring to the drawings, particularly to FIGS. 1 through 5, there is shown a thermistor which has a thermistor element 1 including a body 101 of a PTC material of a circular disc shape provided at the opposite sides with electrodes 102 and 103. The electrodes 102 and 103 are respectively comprised of first electrode layers 102*a* and 103*a*, respectively which are attached to the opposite side surfaces of the thermistor body 101 and second electrode layers 102*b* and 103*b*, respectively, which are attached to the layers 102*a* and 103*a*. The first layers 102*a* and 103*a* are coextensive with respect to the thermistor body 101 and made of an electrically conductive material other than silver. The second layer 102*b* and 103*b* are smaller in diameter than the first layers 102*a* and 102*b* to leave a gap g at the peripheral portion and made of silver. This electrode structure is advantageous in that silver migration into the thermistor body 101 can be prevented.

The thermistor element 1 is supported in a casing 2 made of an electrically insulative plastic material by means of terminal fittings 3A and 3B. The terminal fittings 3A and 3B respectively include resilient contacts 31 which are connected with socket portions 32 and plug portions 33 as shown in anyone of FIGS. 9, 10 and 12. In the example shown in FIG. 11, the terminal fittings 3A and 3B have only the resilient contacts 31 and the socket portions 32.

The casing 2 includes an upper casing half 2A and a lower casing half 2B which are attached to each other at mating surfaces 2C. The lower casing half 2B is substantially of a parallelepipedic configuration and has an internal space 21 which is defined by a pair of opposing walls 23 and 24. The PTC element 1 is fitted to an opening 51 of an electrically insulative plate 5 which is supported by the casing 2 by being fitted to grooves 22 formed coextensively in the inner walls of the casing halves 2A and 2B. The socket portion 32 of the terminal fitting 3A is attached to the wall 23 of the casing half 2B and the socket portion 32 of the terminal fitting 3B is attached to the wall 24 of the casing half 2B. The contacts 31 of the terminal fittings 3A and 3B are held in contact with the electrodes 102 and 103 of the PTC element 1 to thereby resiliently support the PTC element 1 in the casing 2.

Figure 2:
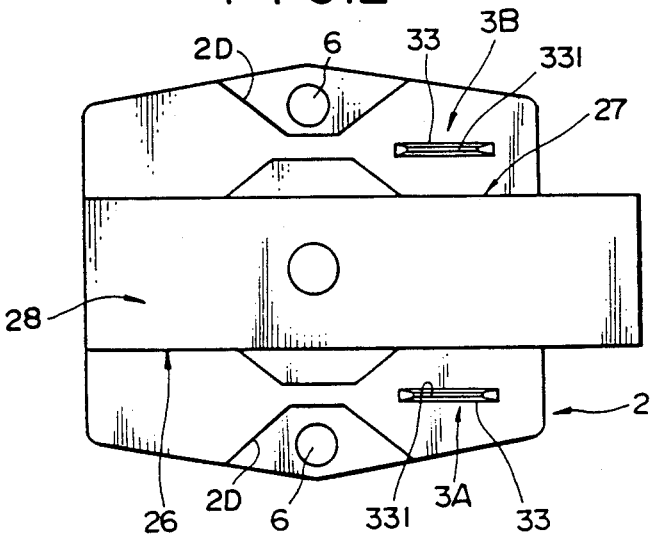
FIG. 2 is a plan view of the thermistor shown in FIG. 1.
Figure 3:
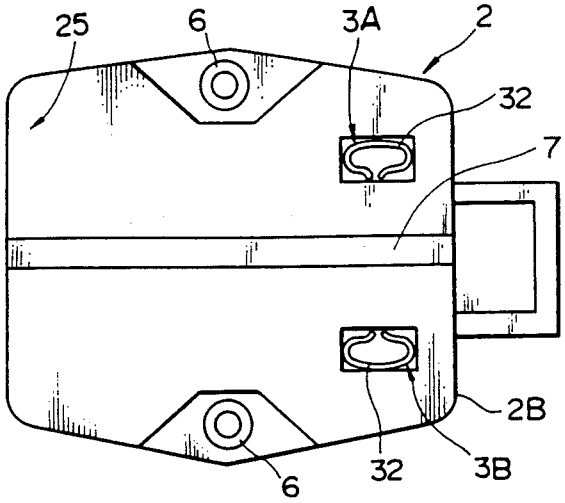
FIG. 3 is a bottom view of the thermistor.
Figure 4:
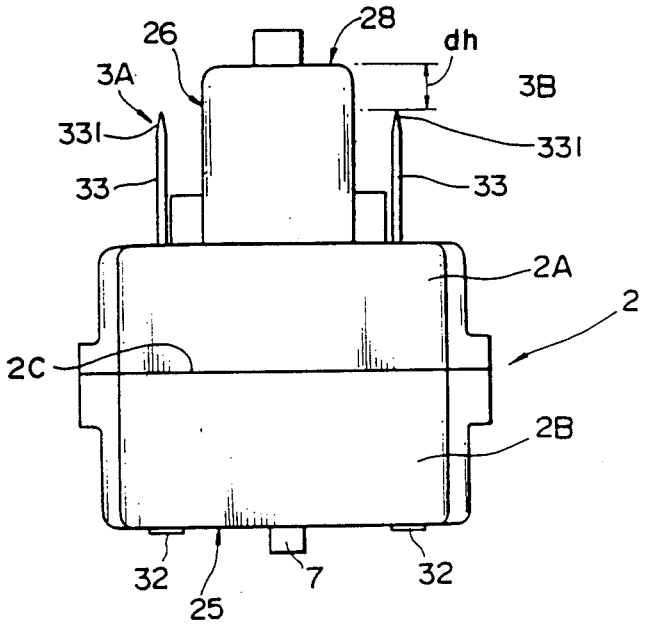
FIG. 4 is a side view of the thermistor.
Figure 5:
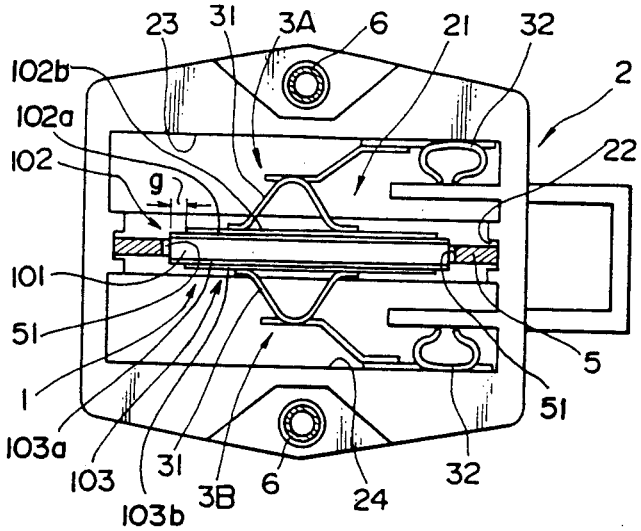
FIG. 5 is a sectional view of the thermistor taken substantially along the line $A_1$—$A_1$ in FIG. 1.

The upper casing half 2A has a lower portion of parallelepipedic configuration complementary to the lower casing half 2B and attached to the lower casing half 2B at the mating surfaces 2C. The upper casing half 2A is further formed with an upper portion which is defined by a pair of substantially planar side surfaces 26 and 27 and a substantially planar top surface 28. As shown in FIG. 2, the upper portion of the upper casing half 2A is formed in the sidewardly center part with respect to the lower portion to project upwardly. The upper portion of the upper casing half 2A is thus shaped to receive the upper portion of the PTC element 1 of the circular disc shape. The lower casing half 2B and the lower portion of the upper casing half 2A are formed at each side with counterbores 2D and the casing halves 2A and 2B are connected as a unit by means of rivets 6 at the counterbores 2D.

The socket portions 32 are exposed outside the casing 2 from the bottom surface 25 of the lower casing half 2B. The plug portions 33 are located at the opposite sides of the upper portion of the upper casing half 2A to project from the top surface of the lower portion of the upper casing half 2A. It will be noted in FIG. 1 that the upper ends 331 of the plug portions 33 are within the confine of the upper portion of the upper casing half 2A. In other words, the length of the plug portion 33 projecting from the top surface of the lower portion of the upper casing half 2A is not larger than the height of the upper portion of the upper casing half 2A. In the embodiment shown in FIGS. 1 through 5, the upper portion of the upper casing half 2A is larger in height by dh than the plug portions 33. Thus, the distance of surface discharge is a sum of the width of the upper surface 28 and the height dh in each of the side surfaces 26 and 27 so that possibility of surface discharge along the surface of the upper portion of the upper casing half 2A across the plug portions 33 is greatly decreased.

It will further be noted that the upper portion of the upper casing half 2A has a planar upper surface 28 as already described. Therefore, it is possible to readily grip the upper portion in mounting the thermistor on a motor and there will be less possibility that the thermistor slips off the hand of a workman in such mounting operation.

In the embodiment shown in FIGS. 1 through 5, the bottom surface 25 of the lower casing half 2B is formed between the socket portions 32 with a ridge 7. With this ridge 7, it is possible when the thermistor is mounted on a motor to provide a gap between the bottom surface of the lower casing half 2B and the adjacent surface of the motor. The gap thus provided will be effective to increase the electric insulative property between the pair of socket portions 32. The ridge 7 is further effective to hold stably the thermistor on the motor to prevent loosening of the engagement between the socket portions 32 and cooperating plug portions on the motor even under vibrations and external forces which the thermistor may be subjected to when it is in service.

Figure 9:
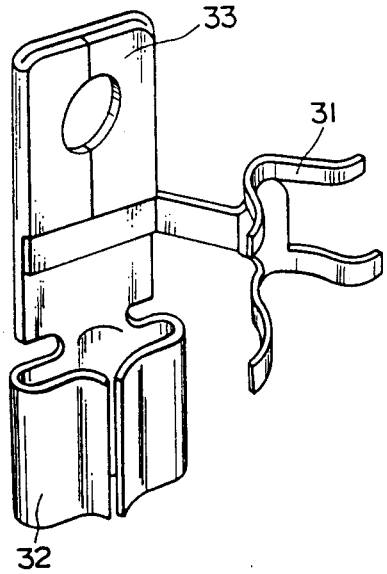
FIGS. 9 through 12 are perspective view showing various types of terminals which can be used in the thermistor of the present invention.

Referring to FIG. 9, there is shown an example of the terminal fitting 3A or 3B. In this example, a metal sheet is formed to provide at the opposite end portions with the aforementioned socket portion 32 and the plug portion 33. The contact 31 is separately formed into a desired configuration and welded to the metal sheet having the socket portion 32 and the plug portion 33 at a position between the socket portion 32 and the plug portion 33. Preferably, the socket portion 32 and the plug portion 33 are made of a metal sheet of Cu-Ti alloy. The contact 31 may also be made of Cu-Ti alloy. It is of course possible to form the contact 31 integrally with the socket portion 32 and the plug portion 33. The terminal fitting made of Cu-Ti alloy is preferable because the alloy has a thermal conductivity much greater than that of a corrosion resistant steel from which the terminal fitting is usually made. In the case where the terminal fitting is made of a material having a good thermal conductivity, it is possible to have the temperature of the thermistor PTC element rapidly decreased when the motor is shut down so that restart of the motor can be made soon. A further advantage of using Cu-Ti alloy is that the alloy is easy to manufacture as compared with a corrosion resistant steel.

Figure 10:
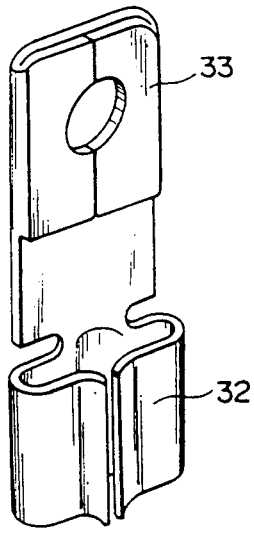
Figure 11:
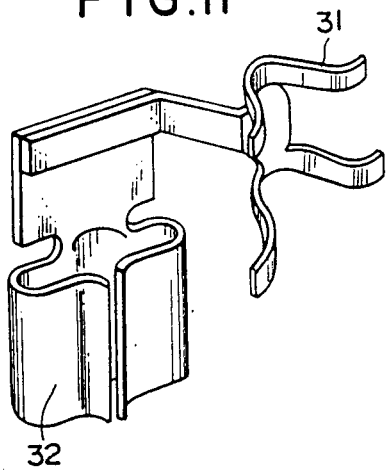
Figure 12:
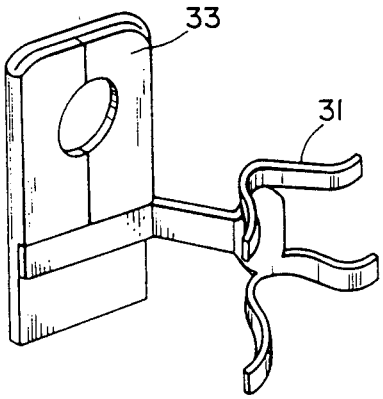

FIG. 10 shows another example of the terminal fitting. In this example, the terminal fitting has a socket portion 32 and a plug portion 33 but does not have the contact as in the example shown in FIG. 9. FIG. 11 shows an example of the terminal fitting which has a socket portion 32 and a contact 31 but does not have a plug portion. FIG. 12 shows an example which has a contact 31 and a plug portion 33 but does not have a socket portion.

Figure 6:
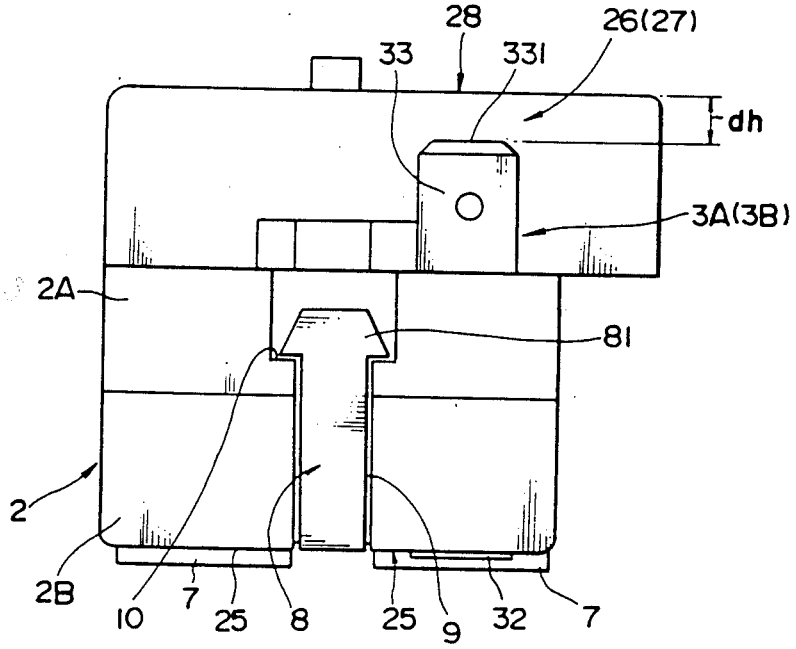
FIG. 6 is a front view in accordance with another embodiment of the present invention.
Figure 7:
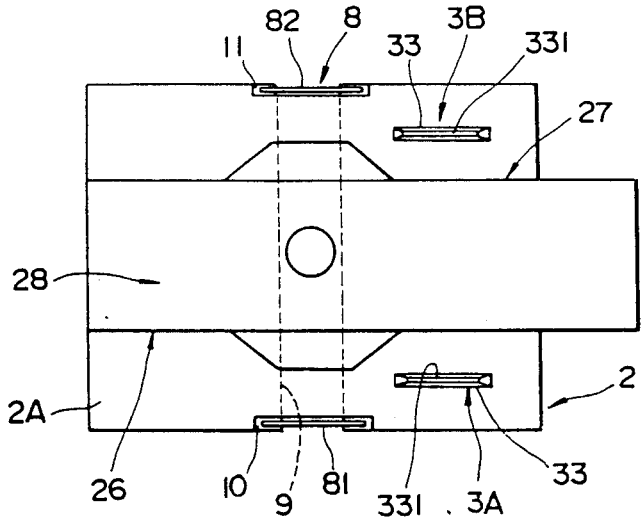
FIG. 7 is a plan view of the thermistor shown in FIG. 6.
Figure 8:
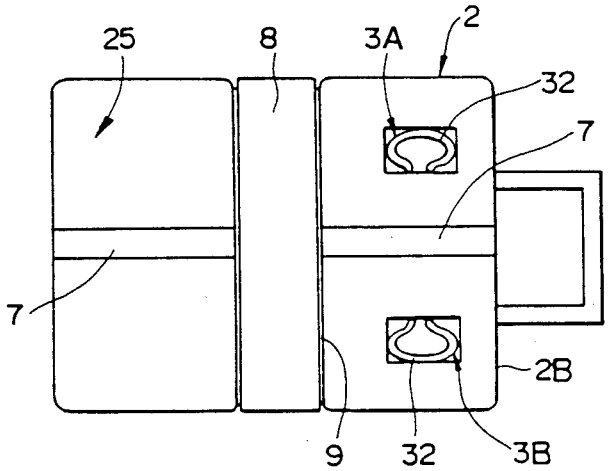
FIG. 8 is a bottom view of the thermistor shown in FIGS. 6 and 7.

Referring to FIGS. 6 through 8, there is shown another embodiment of the present invention. In this embodiment, the thermistor has a casing 2 including an upper casing half 2A and a lower casing half 2B which are connected together by means of a resilient clip band 8 having end portions 81 and 82 engaged with shoulder portions 10 and 11 formed in the upper casing half 2A. In other respects, the structure is the same as that in the previous embodiment.

Figure 13:
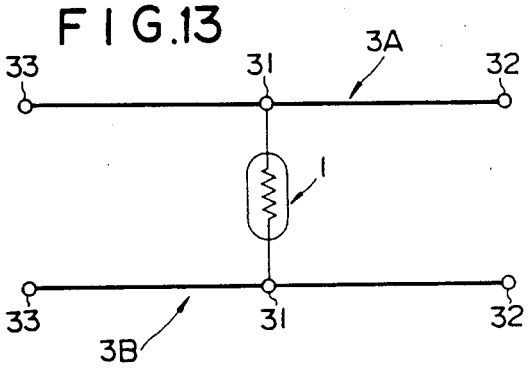
FIGS. 13 through 15 show various examples of connections of the thermistor.
Figure 14:
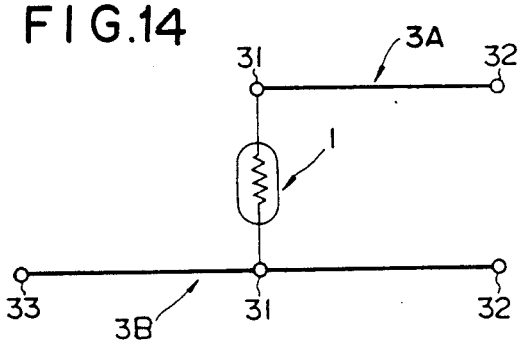
Figure 15:
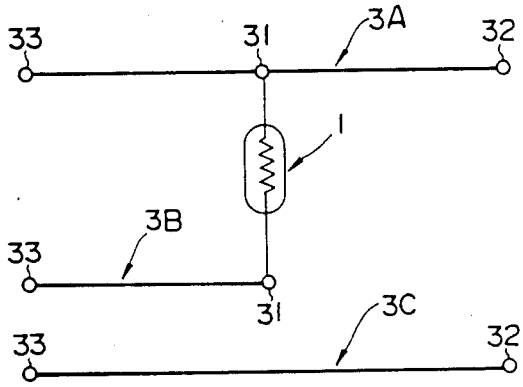

The number of the terminal fittings 3A and 3B and the structure may be changed depending on the arrangement of the motor starting circuit as for example taught by the Japanese utility model publication 58-34722 and the Japanese patent publication 63-18817. FIGS. 13 through 15 show examples of circuit connections using the terminal fittings shown in FIGS. 9 through 12. FIG. 13 shows a circuit connection which can be accomplished by using the structure shown in FIG. 9 for both the terminal fittings 3A and 3B. In the example shown in FIG. 14, the structure shown in FIG. 9 is used for the terminal fitting 3A and the structure of FIG. 11 for the terminal fitting 3B. The circuit shown in FIG. 15 can be provided by using three different types of terminal fittings. More specifically, the structure of FIG. 9 is used for the terminal fitting 3A and the structure of FIG. 12 for the terminal fitting 3B. Further, an additional terminal fitting 3C is provided by using the structure shown in FIG. 10.

Figure 16:
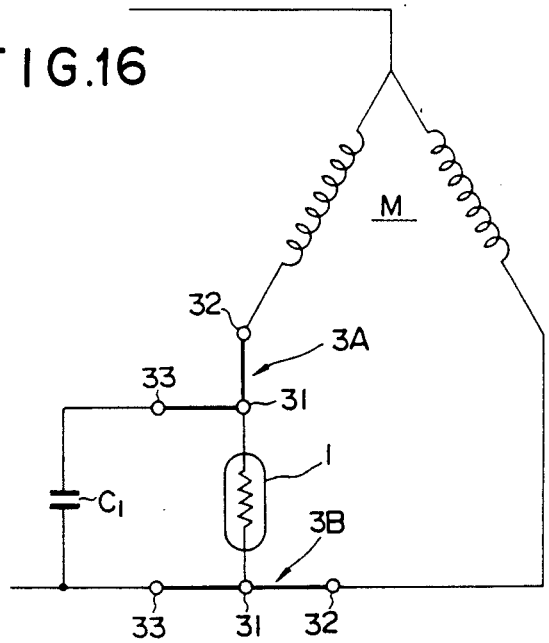
FIGS. 16 through 18 show examples of connections of a thermistor in a motor starting circuit.
Figure 17:
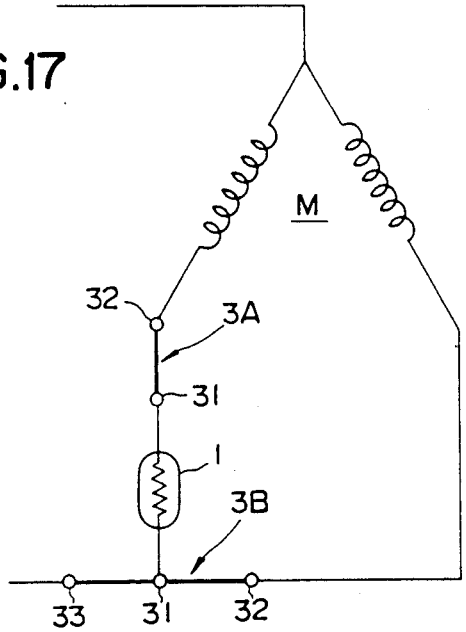
Figure 18:
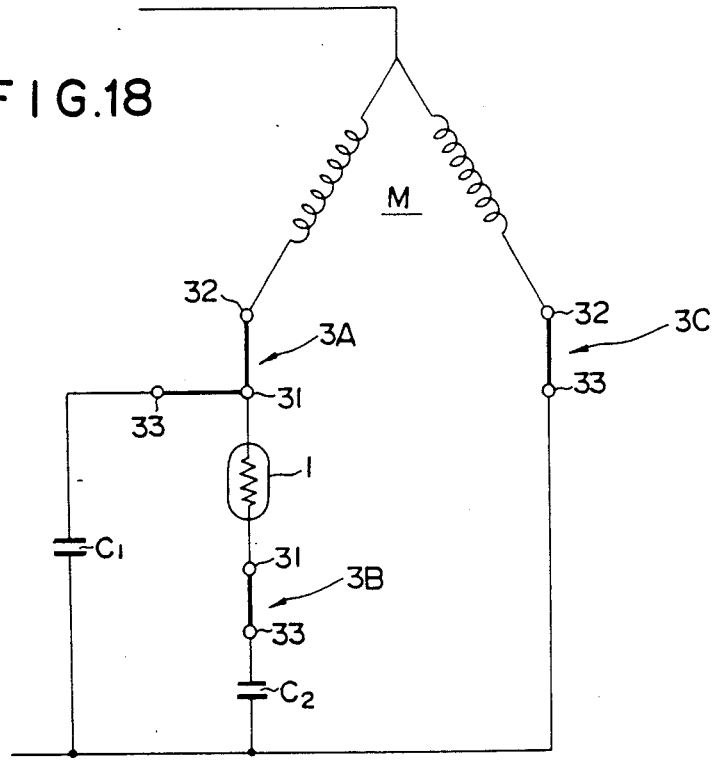
Figure 19:
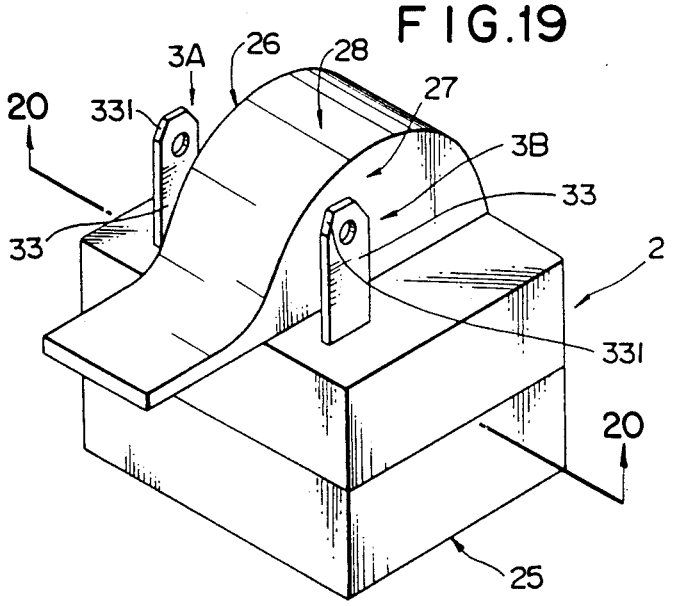
FIG. 19 is a perspective view of a conventional PTC thermistor.
Figure 20:
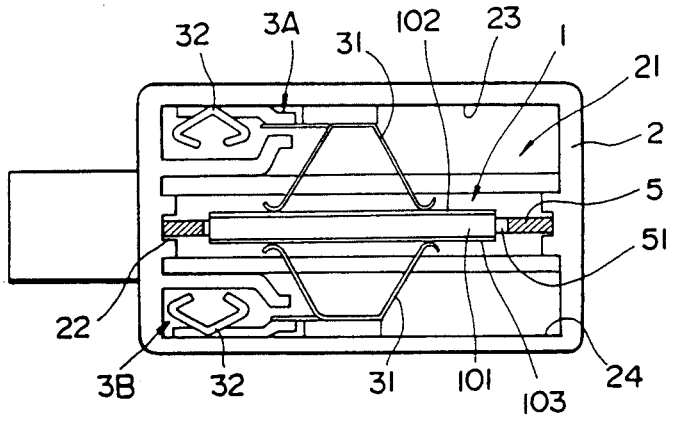
FIG. 20 is a sectional view taken along the line $B_1$—$B_1$ in FIG. 19.
Figure 21:
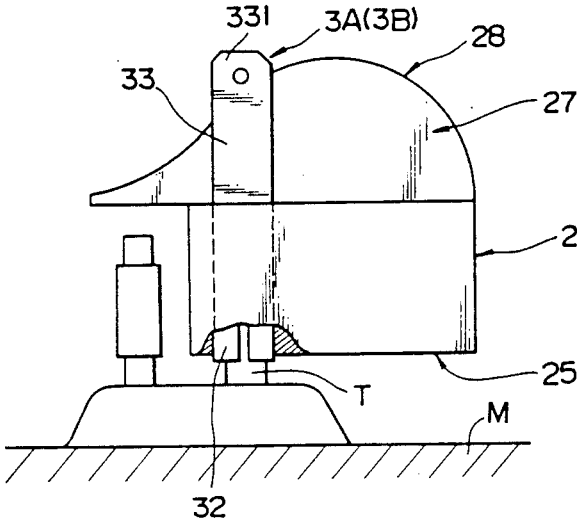
FIG. 21 is a partially broken side view of the conventional thermistor used on a motor starting circuit.

Referring further to FIGS. 16 through 18, there are shown examples of circuits wherein the thermistor circuits shown in FIGS. 13 through 15 are connected in motor starting circuits. FIGS. 16 to 18 respectively correspond to FIGS. 13 to 15. In these figures, the reference M shows the motor and $C_1$ and $C_2$ show motor starting capacitors.

The invention has thus been shown and described with reference to specific embodiments, however, it should be noted that the invention is in no way limited to the details of the specific arrangements but changes and modifications may be made without departing from the scope of the appended claims.

I claim:

1. A PTC thermistor device including a casing and a PTC element supported in said casing, said PTC element having opposite side surfaces provided with electrode means, said casing having opposite side surfaces complementary to said opposite side surfaces of the PTC element, plug means connected with said electrodes and extending outside said casing for external connection, said plug means extending substantially parallel with said opposite side surfaces of the casing, said surfaces of said casing merging to an outer end surface which is of a planar configuration, said plug means terminating at an outer end portion which is located in a confine of said surface of said casing.

2. A PTC thermistor device in accordance with claim 1 in which said electrode at each side of the PTC element is of a two layer structure comprising a first layer attached to the side surface of the PTC element and a second layer on the first layer, said second layer being smaller in diameter than said first layer.

3. A thermistor device in accordance with claim 2 in which said first layer is made of an electrically conductive material other than silver, said second layer being made of silver.

4. A thermistor device in accordance with claim 2 in which said second electrode layer has a diametrical dimension which is smaller than that of the first layer.

5. A thermistor device in accordance with claim 1 in which said plug means is connected with socket means, which is exposed to the outside the casing at a side opposite the side where said plug means is extending.

6. A PTC thermistor device including a casing and a PTC element supported in said casing, said PTC element having opposite side surfaces provided with electrode means, said casing having opposite side surfaces complementary to said opposite side surfaces of the PTC element, electrically conductive terminal means including plug means and contact means connected with said plug means, said contact means being in contact with said electrodes, said plug means extending outside said casing for external connection, said plug means extending substantially parallel with said opposite side surfaces of the casing, said surfaces of said casing merging to an outer end surface which is of a planar configuration, said plug means terminating at an outer end portion which is located in a confine of said outer end surface of said casing.

7. A PTC thermistor in accordance with claim 6 in which said terminal means is at least partially made of Cu-Ti alloy.

8. A PTC thermistor in accordance with claim 6 in which said terminal means is formed at an end wherein said plug means is formed with socket means which is exposed to the outside the casing for an external connection.

9. A PTC thermistor device including a casing and a PTC element supported in said casing, said PTC element having opposite side surfaces provided with electrode means and plug means connected with said electrode means and extending a first distance outside said casing for external connection, and said casing having first and second sections, said second section having first and second parts, said second part extending into an outer end surface of planar configuration, a second distance further than the first distance extended by said plug means.

* * * * *